United States Patent [19]

Fuller et al.

[11] 4,058,433

[45] Nov. 15, 1977

[54] CONVERSION OF SULFUR IN BLANK LIQUOR TO ELIMINATE ODOROUS EMISSIONS AND FACILITATE THE COLLECTION OF SULFATE SOAPS

[75] Inventors: Robert R. Fuller; Donald Blanton Morris, both of Tuscaloosa, Ala.

[73] Assignee: Gulf States Paper Corporation, Tuscaloosa, Ala.

[21] Appl. No.: 555,872

[22] Filed: Mar. 6, 1975

[51] Int. Cl.[2] ..... D21C 11/08

[52] U.S. Cl. ..... 162/16; 162/31; 162/49; 162/51; 162/65; 210/63 R

[58] Field of Search ..... 162/16, 30, 31, 49, 162/51, 60, 65; 210/63; 261/913, DIG. 75, 128; 423/206, 642, 514

[56] References Cited

U.S. PATENT DOCUMENTS

| | | | |
|---|---|---|---|
| 1,260,432 | 5/1932 | Richter | 162/65 |
| 1,454,339 | 5/1923 | Richter | 162/51 |
| 1,643,566 | 9/1927 | Thorne | 162/19 |
| 1,804,893 | 5/1931 | Seidel et al. | 162/65 |
| 1,987,195 | 1/1935 | Kipper | 162/23 |
| 2,570,460 | 10/1951 | Kress | 23/283 |
| 2,673,148 | 3/1954 | Harris | 162/65 |
| 2,686,120 | 8/1954 | Marshall et al. | 162/14 |
| 2,758,017 | 8/1956 | Allen et al. | 162/31 |
| 2,830,869 | 4/1958 | Limerick | 21/55 |
| 2,830,870 | 4/1958 | Limerick | 21/55 |
| 2,926,114 | 2/1960 | Grangaard et al. | 162/16 |
| 3,024,158 | 3/1962 | Grangaard et al. | 162/17 |
| 3,028,295 | 4/1962 | Trobeck et al. | 162/51 |
| 3,178,260 | 4/1965 | Tirado | 210/63 |
| 3,183,145 | 5/1965 | Collins | 162/30 |
| 3,251,730 | 5/1966 | Watanabe | 162/56 |
| 3,311,531 | 3/1967 | Feischl et al. | 162/51 |
| 3,313,680 | 4/1967 | Hoar | 162/239 |
| 3,347,739 | 10/1967 | Tomlinson | 162/30 |
| 3,362,868 | 1/1968 | Backlund | 162/30 |
| 3,404,063 | 10/1968 | Harding | 162/16 |
| 3,425,899 | 2/1969 | Nilsson | 162/30 |
| 3,428,520 | 2/1969 | Yiannos | 162/38 |
| 3,460,810 | 8/1969 | Mueller | 261/93 |
| 3,549,314 | 12/1970 | Shah | 162/30 |
| 3,554,859 | 1/1971 | Murray | 162/30 |
| 3,654,070 | 4/1972 | Prabt et al. | 162/30 |
| 3,655,343 | 4/1972 | Galeano | 162/31 |
| 3,660,225 | 5/1972 | Verreyne et al. | 162/17 |
| 3,709,975 | 1/1973 | Amsden et al. | 162/30 |
| 3,713,629 | 1/1973 | Rieter | 261/112 |
| 3,804,255 | 4/1974 | Speece | 210/194 |
| 3,873,414 | 3/1975 | Rocher et al. | 162/30 |

FOREIGN PATENT DOCUMENTS

| | | |
|---|---|---|
| 120,170 | 9/1970 | Norway |
| 818,572 | 8/1959 | United Kingdom |

OTHER PUBLICATIONS

"Abstract Bulletin Institute of Paper Chemistry," vol. 42, No. 12,016, Effective date, 10/73.

"Tappi" vol. 53, No. 11, Nov. 1970, 2142–2146.

Polyakov et al., "Oxidation of Kraft Black Liquor in a Turbulent Scrubber" Khim. Teklnd. Tsellyul. Bumugi, 182–186 (1973), ABIPC Abstract, vol. 46, No. 2,1604.

Valiquette, G. H., "Reduce Recovery Boiler Emissions", Pulp & Paper Canada, vol. 75, No. 12, 12/74.

Fones et al., "Oxidation of Kraft Black Liquor with Pure Oxygen" Tappi, Apr. 1960, vol. 43, No. 4.

*Primary Examiner*—S. Leon Bashore
*Assistant Examiner*—William F. Smith
*Attorney, Agent, or Firm*—Raphael Semmes

[57] ABSTRACT

Oxidation and fixing of sulfur and sulfur compounds in weak black liquor is accomplished by methods which insure minimal odorous sulfur emissions and which facilitate the collection of sulfate soaps. By critical adjustment of certain parameters substantially complete oxidation of sulfur and sulfur compounds is achieved, with maximum utilization of oxygen, while enhancing the collection of sulfate soaps and minimizing the production of foam. Various methods are disclosed for the oxygenation of weak black liquor, including the utilization of reaction columns, conical reactors, and venturis.

29 Claims, 11 Drawing Figures

CONVERSION OF SULFUR IN BLANK LIQUOR TO ELIMINATE ODOROUS EMISSIONS AND FACILITATE THE COLLECTION OF SULFATE SOAPS

BACKGROUND OF THE INVENTION

The present invention is concerned with the oxidation of sulfur in weak black liquor and with the elimination of odorous sulfur emissions and the production of sulfate soaps in kraft pulp mills.

In the manufacture of paper by the kraft or sulfate process, sulfur is present in the chemical solution used to cook wood to obtain fiber, as sodium sulfide, or other sulfur compounds or elemental sulfur. The use of sulfur enhances the separation of cellulose fiber from wood and has other benefits, including stronger fibers, fewer rejects of incompletely separated material, and less dirt.

Unfortunately, the use of sulfur results in the formation of odorous chemical compounds such as hydrogen sulfide, mercaptans, disulfides, and the like, which are released at many points in the kraft pulping operation. Odorous compounds are emitted in small quantities at the digester, through gas-off of non-condensables during the cooking reaction. At the end of the digestion reaction when the digester is emptied to a blow tank, odorous chemicals are released. In the washing-filtration operation for the separation of dissolved non-cellulose parts of the wood and cooking chemicals from the fiber, odorous chemicals are stripped to the atmosphere. The disposal of woody material removed in the washing operation and the recovery and storage of cooking chemical solutions also produce odorous emissions. In the concentration of the stored solution by an evaporation system, odorous sulfur compounds are again emitted. Following concentration, when the solution of wood-chemical material is burned in a furnace to produce steam and molten smelt from which the cooking chemicals are recovered, odorous emissions are again released.

The paper industry has attempted to eliminate or control the creation and emission of odorous chemicals for a long time. In an effort to solve the problem, oxidation of sulfur and sulfur compounds in black liquor has been extensively investigated. It has been proposed, for example, to add oxygen to the digester, but possible adverse effects upon pulp quality have been noted in some instances, and prohibitively high oxygen requirements have been encountered at the elevated temperatures and pressures in the digester. It has also been proposed to oxidize weak black liquor (before concentration), but large capital investments have been required, and the practice has been discouraged in mills using coniferous woods because of the production of high volumes of stable foam whenever weak resinous black liquor is sparged with air. When the resinous weak black liquor is concentrated and most of the sulfate soaps are skimmed off, the strong black liquor exhibits a much reduced foaming propensity, and it is current practice to oxidize the black liquor after concentration, with air. However, weak black liquor oxidation has certain advantages over concentrated black liquor oxidation, including reduction of corrosion in the evaporators and improved heat transfer, reduction of odorous non-condensable gases in the evaporator condensate, recovery of the sulfur values through the stabilization of the odorous non-condensable gases, and lower horsepower requirement. Moreover, strong black liquor oxidation fails to treat the problem of odorous emissions from many of the sources in the kraft process.

As alluded to above, sulfate soap, a byproduct of the manufacture of pulp, particularly from coniferous wood, is a major factor in the creation of foam when air, with its high nitrogen content, or other inert gas is bubbled through black liquor. The black liquor from highly resinous woods produces a foam that is most difficult to break. Nevertheless, sulfate soap is a highly desirable byproduct, because it may be reacted with sulfuric acid to form tall oil, a useful article of commerce. At present, only part of the sulfate soap is extracted from the black liquor.

In general, the prior art suffers from one or more of the following deficiencies: inadequate fixation of sulfur, stripping of sulfur to the atmosphere by air used in oxidation, excessive and/or uncontrolled use of oxygen (with resultant oxidation of organics, reduction of heat value of black liquor, reduction in tall oil quality, and explosions), inability to treat black liquor containing significant fiber concentrations, degradation of pulp quality, foaming, difficult sulfate soap separation, poor sulfate soap yields and quality, complexity, impracticality, unreliability, frequent maintenance problems, and high cost.

BRIEF DESCRIPTION OF THE INVENTION

It is accordingly an object of the present invention to provide a solution to the difficult problem of odorous sulfur emissions in a kraft pulping operation and at the same time to enhance the production of sulfate soap.

A further object of the invention is to provide improved methods of oxidizing black liquor or the like, improved methods of producing sulfate soap, which are economical as well as effective, and improved oxygenation apparatus.

Briefly stated, the present invention involves, inter alia, the oxidation of sulfur and sulfur compounds (all referred to as "sulfur" hereinafter) in weak black liquor, preferably at a point between the outlet of the blow tank and the inlet of the washers of a kraft pulp mill. To minimize odorous sulfur emissions it has been found necessary to provide sufficient oxygen to oxidize substantially all of the sulfur present in the digester, rather than some residual quantity. Oxidizing between the blow tank and the washers involves oxidizing in the presence of the cellulose fiber at various consistencies. This has been found to be feasible, in accordance with the invention, employing oxidizing techniques that insure substantially complete oxidation of the sulfur and maximum utilization of the oxygen, while enhancing the production of sulfate soaps. By the critical adjustment of operating parameters in various types of oxidation reactors, the goals of the invention are achieved.

BRIEF DESCRIPTION OF THE DRAWINGS

The invention will be further described in conjunction with the accompanying drawings, wherein.

DETAILED DESCRIPTION OF THE INVENTION

Figure 1:
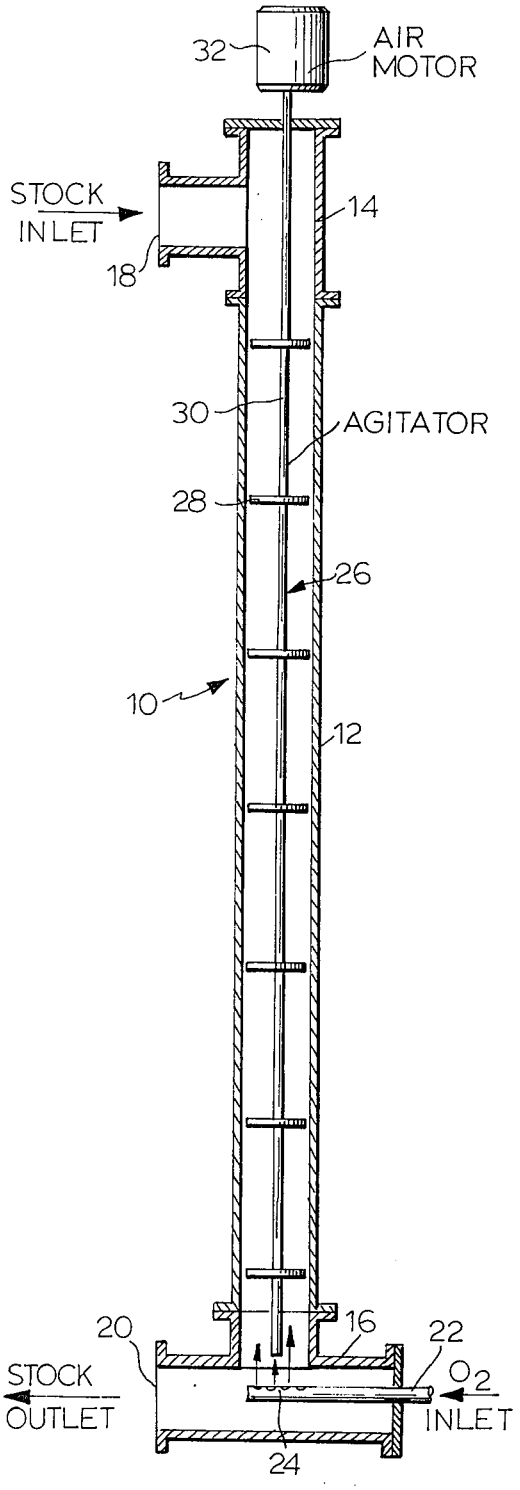
FIG. 1 is a vertical sectional view illustrating the utilization of a first form of apparatus in the performance of a method of the invention.

From the extensive research in the prior art on the oxidation of black liquor, possible oxidation reactions and their kinetics have been advanced. In general, prior work appears to be based on the assumption that it is necessary to oxidize residual, unreacted sodium sulfide to eliminate odorous emissions. In the research underlying the present invention, however, it has been found necessary to oxidize the total sulfur present, rather than some residual quantity, in order to eliminate odorous sulfur emissions. The amount of unreacted sulfur remaining after oxidation must be as little as 0.1 mg./liter to attain the desired very low total reducible sulfur emission. An example will indicate the magnitude of the problem. In a kraft process employing a low sulfide ratio white liquor containing 0.20 pounds per gallon of sodium sulfide as sodium oxide, and employing the usual dilution black liquor, it is calculated that about 40 pounds of sulfur per thousand gallons of liquid is present in the filled digester, and it has been found by analytical experiment that about 32 pounds of sulfur per thousand gallons is present in the digester just before blow.

In accordance with the invention, it is desired to oxidize the sulfur as completely as possible as early as possible, very preferably before the washers. Oxidation of sulfur in the digester, in the blow tank, or between the digester and the blow tank is possible, but is deemed impractical. The preferred practical point for carrying out the oxidation at the earliest possible time, in order to minimize sulfurous emissions, is immediately after the blow tank. Oxidizing and fixing sulfur completely at this point eliminates odorous sulfur emissions from the system except the rather minor emissions in the digester gas-off and blow release.

Oxidation of large quantities of sulfur so early in the kraft process by conventional oxidation methods would, in accordance with prior art teachings, be impractical, because of the need for supplying a large volume of air, the inability to handle large quantities of stable foam produced by the aeration of resinous black liquor, and the inability to accommodate substantial amounts of cellulose fiber in the black liquor. Maximum oxidation of the sulfur would appear to require high ratios of oxygen to sulfur, with the attendant problems noted above, and low ratios of oxygen to sulfur would appear to preclude the total oxidation of sulfur required for avoiding the odorous emissions. It is accordingly necessary to obtain complete oxidation of the sulfur with minimum oxygen requirements. This has been found to be feasible in accordance with the present invention, by oxidation methods which provide sufficient oxygen for total oxidation of the sulfur but without requiring excessive amounts of oxygen. Moreover, with the oxidation methods of the invention it has been found possible to accommodate black liquor containing up to 4% consistency cellulose fiber by weight, to avoid the foaming problems which have plagued the prior art, and to enhance the production and collection of sulfate soap. Reaction times less than three minutes, and in many cases less than one minute, have been found to be sufficient to achieve the desired results.

It should be mentioned that although the highly preferred methods of the invention involve oxidation after the blow tank and before the washers, the oxidation methods of the invention may be carried out at other points in the process, and on black liquor or the like without substantial fiber content. The advantages of total sulfur oxidation early in the kraft process would of course not be achieved, however, at points later in the process.

Although air and oxygen have both been utilized in prior black liquor oxidation, in the present invention it is preferred to employ oxygen of 90 to 100% purity or oxygen-enriched air (which may have similar oxygen concentration) to avoid the problems which have been previously encountered when large quantities of gas are bubbled through black liquor. While lower oxygen concentrations, say 85%, may be used in certain applications, in any event the oxygen concentration must be much higher than that of air. The term "oxygen-rich gas" will be used herein to connote oxygen of the aforesaid purity or oxygen-enriched air of similar oxygen concentration. By employing such a gas in the oxidation of the sulfur in accordance with the methods of the invention, it has been found possible to oxidize the sulfur completely without stripping out and emission of the sulfur and without the production of excessive foam. In fact, after the complete oxidation of sulfur in accordance with the invention it has been found feasible to introduce just enough air or inert gas to promote the removal of soap and at the same time stay within the ability to break the foam, thereby to recover additional soap over that now attained in conventional practice without producing odorous emissions. Also, oxidation of the sulfur prior to the washers facilitates the separation of the liquor from the fiber at the washers.

In accordance with a first embodiment of the invention, an oxidizing method is employed in which oxygen and weak black liquor flow in a counter-current arrangement. Although counter-current reactors have been used previously for oxidizing black liquor, it has been found necessary, in accordance with the present invention, to employ critically adjusted operating parameters in order to achieve the desired results of the invention.

FIG. 1 illustrates a counter-flow reactor column 10 principally formed of a vertical glass pipe 12 8 feet long and 6 inches in diameter. The glass pipe is fitted with stainless steel T's 14 and 16 at the ends to provide a weak black liquor stock inlet 18 at the top and an outlet 20 at the bottom. The reactor column discharges to a holding tank or standpipe or through a controlled discharge (not shown) to maintain the column full to the top. A gas inlet 22 terminates in a disperser or sparger 24 by which finely dispersed small bubbles (preferably from 1/16 to ½ inch diameter) of oxygen-rich gas may be injected into the black liquor at the bottom of the column 12. An agitator 26 having a plurality of paddles 28 is also provided, successive paddles being relatively oriented at 90° about the perimeter of a drive shaft 30 driven by an air motor 32.

Figure 11:
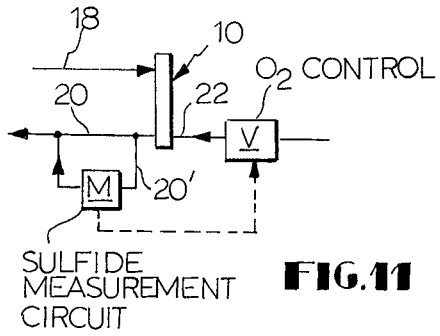
FIG. 11 is a block diagram of an automatic oxygen control system.

In test runs (at various reactor pressures) weak black liquor stock at 1 to 1.5% fiber consistency was introduced into the reactor through the inlet 18 and oxygen of 90 to 100% purity was introduced through the inlet 22 and bubbled upwardly through the column 12. To obtain good oxidation, it was found necessary to obtain good dissolution of the oxygen in the black liquor. The proper dissolving action is one of fine bubbles rising in the column against the flow of liquor and dissolving as they rise. In proper operation, the center half of the column contains a mass of froth having the appearance of foam, and the top and bottom quarters contain clear flowing (quiescent) liquor. The downward liquid flow velocity should be just enough to allow the gas bubbles to rise and form the froth section. The preferred liquid flow velocity in the reactor column is in the range of from about 0.10 to about 0.25 feet per second, but in any event must be less than about 1 foot per second. In order to ascertain the proper operating conditions a sulfide specific ion electrode was used to measure reactor exit sulfide concentration. As shown in FIG. 11, the electrode may be part of a conventional measurement circuit M in a side branch 20' (or in the main discharge pipe), the electrical output of which (e.g., from a millivolt meter) varies a conventional oxygen control (valve) V to maintain complete sulfur oxidation with minimal oxygen. It was found that substantially complete sulfur oxidation was obtained with an oxygen to sulfur ratio of approximately 1.2 to 1 (lbs. $O_2$/lb.S). Two test runs are shown in the following table.

TABLE I

| FLOW GPM | #S/1000 GAL. BLK LIQUOR | #$O_2$/#S | PRESSURE PSIG | TEMPERATURE ° F |
|---|---|---|---|---|
| 12.17 | 5.9 | 1.19 | 14.7 | 152 |
| 20.4 | 2.4 | 1.15 | 10.0 | 144 |

Figure 2:
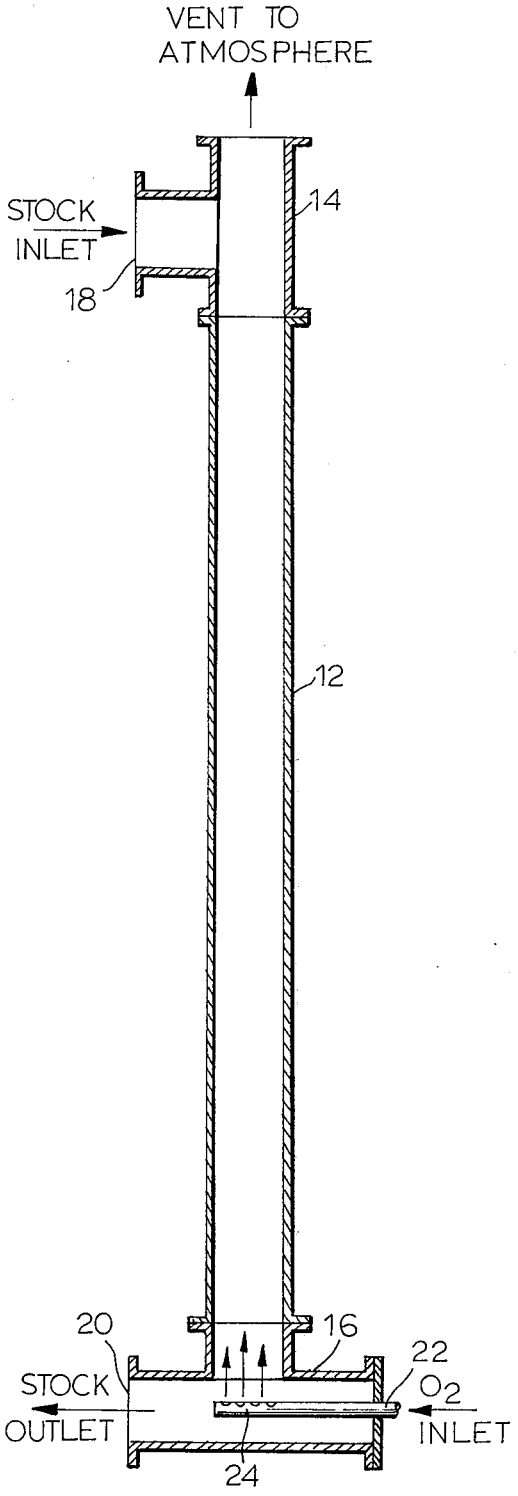
FIG. 2 is a similar view illustrating utilization of a modified form of apparatus.

In the interest of safety, the reactor was modified as shown in FIG. 2 so as to be open to the atmosphere. The agitator (which was found to have minimal effect upon the dissolution of oxygen) was removed. Oxygen to sulfur ratios were determined for fixed stock flows. The data in Table II below were collected from six runs.

TABLE II

| TEST NUMBER | FLOW GPM | Residual #S/1000 GAL. BLK LIQUOR | #$O_2$/#S | TEMPERATURE ° F |
|---|---|---|---|---|
| I | 15.7 | 5.90 | 0 | 169 |
| | | 2.47 | 0.634 | |
| | | 1.37 | 0.935 | |
| | | 0.27 | 1.182 | |
| | | 0.04 | 1.279 | |
| II | 18.0 | 6.27 | 0 | 186 |
| | | 3.78 | 0.350 | |
| | | 2.33 | 0.558 | |
| | | 0.36 | 0.796 | |
| | | *ND | 1.008 | |
| III | 19.6 | 3.80 | 0 | 172 |
| | | 2.64 | 0.373 | |
| | | 1.60 | 0.853 | |
| | | 0.60 | 1.107 | |
| | | *ND | 1.533 | |
| IV | 19.9 | 2.27 | 0 | 154 |
| | | 0.70 | 0.688 | |
| | | 0.13 | 1.33 | |
| | | 0.06 | 1.53 | |
| | | *ND | 1.93 | |
| V | 20.4 | 2.20 | 0 | 175 |
| | | 1.00 | 0.401 | |
| | | 0.47 | 0.791 | |
| | | 0.13 | 1.046 | |
| | | *ND | 1.457 | |
| VI | 20.2 | 1.27 | 0 | 144 |
| | | 0.46 | 0.938 | |
| | | 0.173 | 1.25 | |
| | | 0.04 | 1.56 | |
| | | *ND | 2.34 | |

*ND NONE DETECTED

Figure 4:
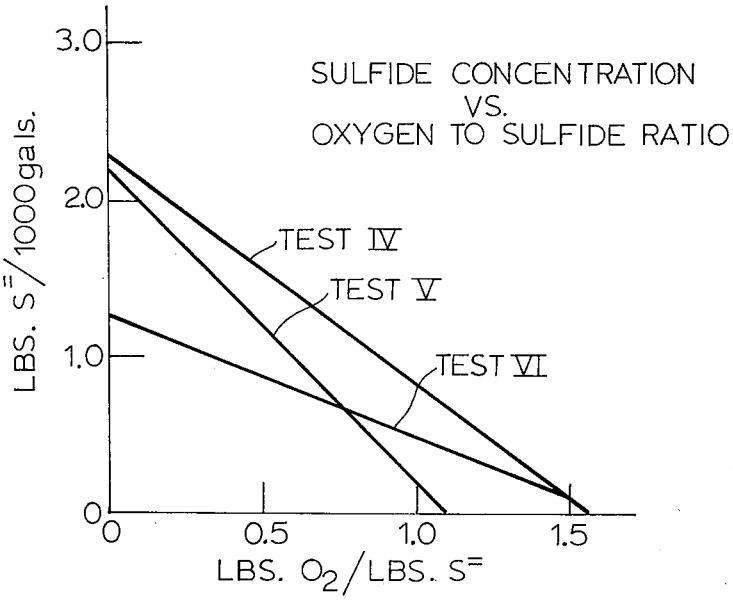
FIGS. 3 and 4 are graphical diagrams illustrating the results of test runs employing methods of the invention.
Figure 3:
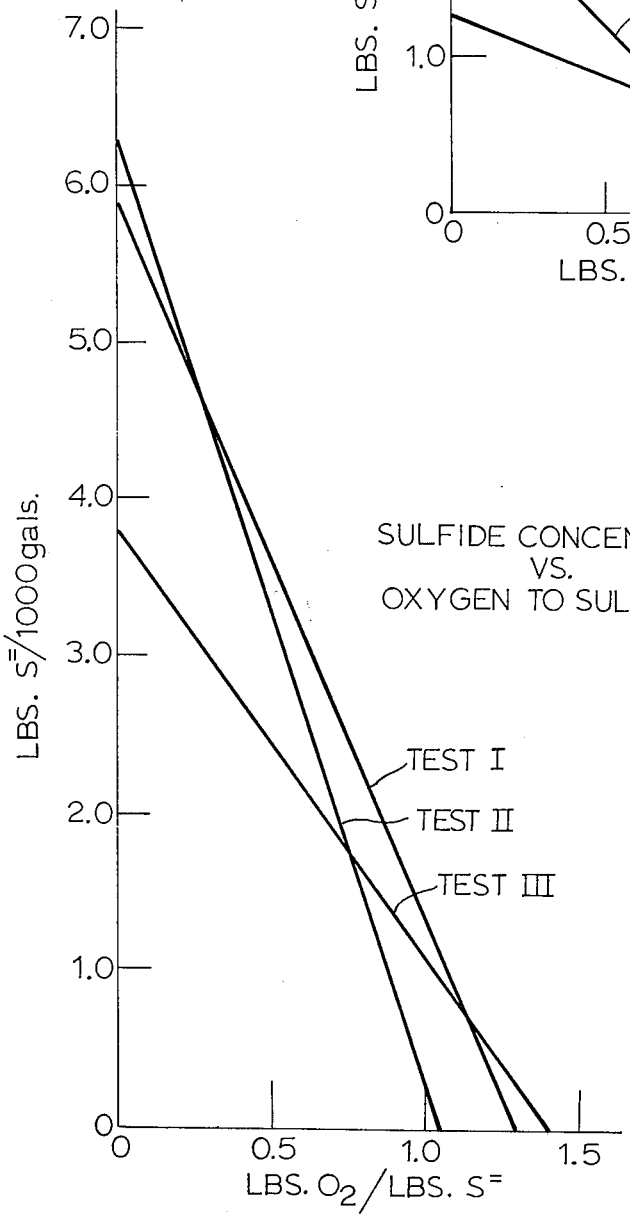

Plots of these data, presented in the graphs of FIGS. 3 and 4, were extrapolated to zero sulfide concentration to yield the true oxygen to sulfur ratios required for complete oxidation. The values of $O_2$/S ratios at zero sulfide are seen in Table III.

TABLE III

OXYGEN TO SULFUR RATIO AT ZERO SULFIDE FROM GRAPHS

| TEST NUMBER | FLOW GPM | #$O_2$/#S | TEMPERATURE ° F |
|---|---|---|---|
| I | 15.7 | 1.25 | 169 |
| II | 18.0 | 1.03 | 186 |
| III | 19.6 | 1.39 | 172 |
| IV | 19.9 | 1.58 | 154 |
| V | 20.4 | 1.09 | 175 |
| VI | 20.2 | 1.65 | 144 |

The average value for $O_2$/S is 1.33 to 1. However, it is seen that if test runs 4 and 6 at 154° F. and 144° F. are excluded, the average is 1.19 to 1. The exclusion of these test runs is deemed to be appropriate in view of the prior art teaching that sulfur reversion occurs principally at temperatures below 165° F. The data of Tables II and III indicate that properly adjusted counter-current oxidation in 1 to 1.5% stock is feasible at attractive oxygen to sulfur ratios. Although temperatures higher than those employed in the foregoing test runs are preferred, as will be set forth later, the tests show that with proper dissolution of oxygen the oxidation reactions will go to completion with lower oxygen usage ratios and at lower temperatures than taught by the prior art.

To further support the data, steady state oxidation experiments were conducted. These experiments were of ten to forty minutes duration. Black liquor containing fiber was fed from a mixed tank, assuring a constant inlet concentration of sulfide. Oxygen was added to the reactor at a rate such that zero sulfide concentration existed in the stock leaving the reactor, stock flow being constant. Sulfide concentrations on the inlet stream were measured by silver nitrate titration. The exit stream concentration was determined by a sulfide ion electrode. The data of Table IV were collected from the steady state runs.

TABLE IV

OPERATIONS AT ZERO SULFIDE RESIDUAL AS MEASURED BY ELECTRODE

| | FLOW | INLET S# CONC. #S/1000 GAL | $O_2$/S= RATIO | TEMPERATURE OF | RETENTION TIME SECONDS |
|---|---|---|---|---|---|
| 1 | 15.7 | 5.90 | 1.30 | 169 | 45 |
| 2 | 18.0 | 6.27 | 1.10 | 186 | 39 |
| 3 | 19.6 | 3.80 | 1.40 | 172 | 36 |
| 4 | 20.4 | 2.20 | 1.15 | 175 | 33 |
| 5 | 18.8 | 2.93 | 1.12 | | 33 |
| 6 | 15.7 | 5.20 | 1.25 | | 38 |
| 7 | 13.7 | 5.90 | 1.54 | | 52 |
| 8 | 9.8 | 6.27 | 1.20 | 175 | 72 |
| 9 | 19.6 | 4.13 | 1.20 | 142 | 36 |
| 10 | 20.4 | 2.20 | 1.14 | | 35 |

In each case the residual sulfide was zero as measured by the sulfide ion electrode. It is seen that for ten test runs the average oxygen to sulfur ratio is 1.24 to 1. The average retention time to attain zero sulfide is 42.3 seconds.

Figure 7:
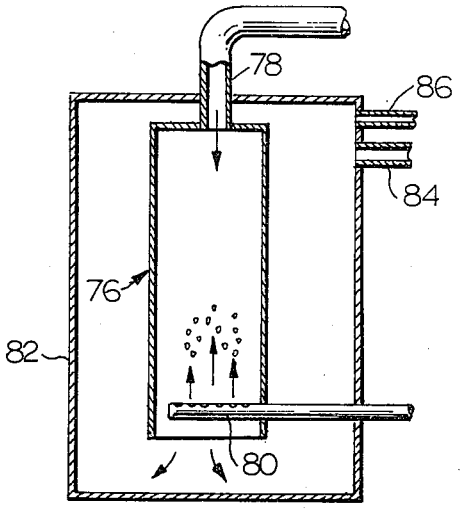
Figure 8:
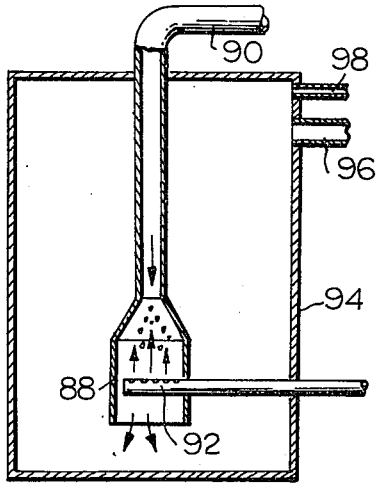
Figure 10:
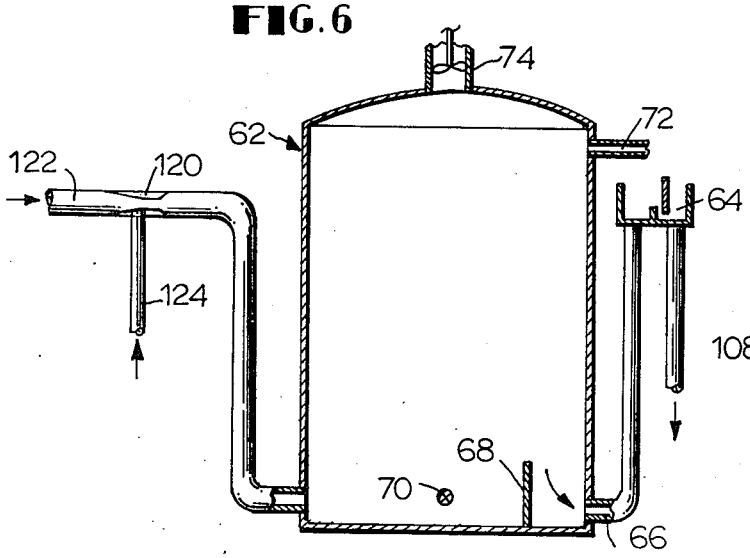
Figure 9:
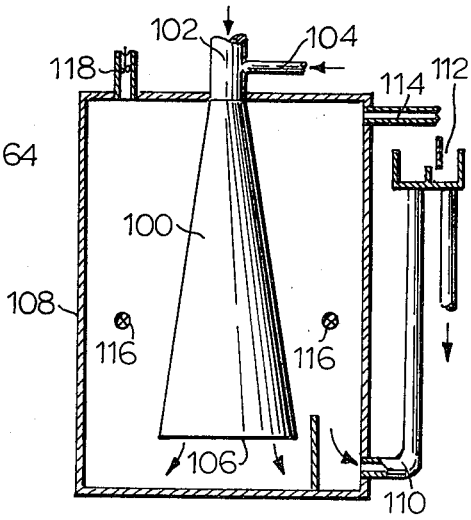

FIGS. 5–10 illustrate various practical embodiments for the performance of black liquor oxidation methods in accordance with the invention, FIGS. 5–8 illustrating counter-current embodiments and FIGS. 9 and 10 co-current embodiments. In each instance critical adjustment of operating parameters is required in order to achieve the improved results of the invention.

Figure 5:
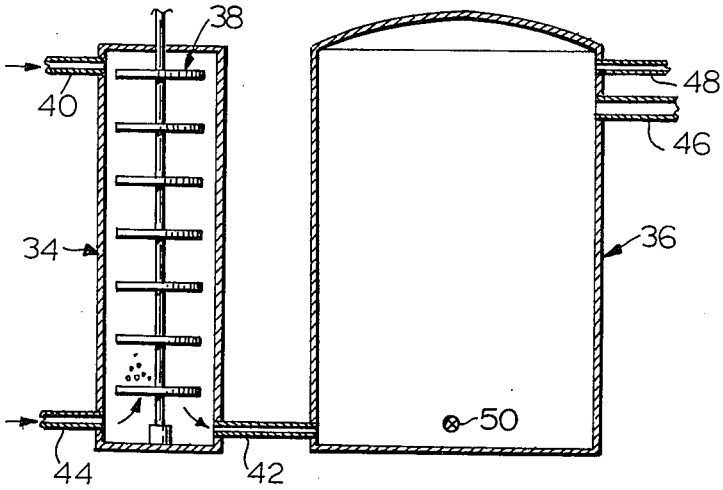
FIGS. 5–10 are vertical sectional views of various other forms of apparatus employed in the performance of the methods of the invention.

In FIG. 5 a black liquor oxidation method in accordance with the invention utilizes a reaction chamber 34 discharging to a holding tank 36. The reaction chamber is shown as containing an agitator 38 driven by a motor (not shown) to assist in maintaining fiber in suspension and to aid dissolution of oxygen, although as noted previously the agitator may be deleted. Black liquor containing fiber in suspension enters the reaction chamber near the top through an inlet 40 at sufficient velocity to dissolve any free oxygen that might collect and flows downwardly through the reaction chamber to the outlet 42 near the bottom. Oxygen-rich gas enters the reaction chamber near the bottom through a gas inlet 44 and is finely dispersed as small bubbles by a conventional disperser or sparger (which has not been illustrated, for simplification of the drawing). The bubbles migrate upwardly in the reaction chamber and dissolve in the downwardly flowing black liquor. Oxidized black liquor is discharged from the reaction chamber through outlet 42 to the holding tank 36, the liquor-fiber rising to a level determined by the outlet 46, through which oxidized black liquor overflows. Instead of overflowing, the fiber-liquor suspension may be pumped or allowed to flow from the lower end of the tank at a rate controlled by a level control to keep the tank full (as will be described in other embodiments hereinafter). Any unreacted oxygen will react in tank 36.

Sulfate soap may be collected and decanted at soap outlet 48. Sulfate soap is in the liquor in solution and as dispersed particles. As the black liquor stands quiescent and cools, the inorganic sodium compounds cause the soap to "salt out." As the soap is of lower density than the liquor, it will float to the top. Soap collection may be enhanced by the introduction of fine air bubbles in the lower part of the tank, as indicated diagrammatically by reference character 50. A conventional sparger (not shown) may be used to distribute the air through the tank. Air passing through the black liquor tends to make the soap particles agglomerate and changes their density so that they rise to the top faster. It has been found that when the total sulfur in the weak black liquor has been almost completely oxidized prior to the holding tank 36, soap production may be enhanced by the introduction of air or other inert gas into the lower part of the holding tank without creating a foam problem. Just enough air is introduced to float or froth the soap to the surface. With the sulfur fixed by the previous oxidation, which reduces the foaming tendency of the black liquor, sufficient air can be introduced to enhance the production of soap without producing excessive foam and without concern for stripping sulfur to the atmosphere. The restricted use of inert gas in the previous oxidation process (using oxygen-rich gas) avoids the problem of sulfur stripping in that process also.

Soap collected from such black liquor-fiber mixture is likely to be high in fiber content, and if desired the soap collection feature at this point may be omitted, with the reactor outlet 42 being connected to feed directly to subsequent processing steps. Stripping the soap from the black liquor would then be effected after separation of the black liquor from the fiber. A length of pipe extending from the outlet 42 could provide any additional dwell time required for completion of the oxidation.

In FIG. 5 and in the other embodiments described herein, except FIG. 10, it has been found to be essential that the inlet velocity of the black liquor (through inlet 40 in FIG. 5) be at least about eight feet per second to prevent oxygen from migrating into the inlet, with consequent inefficiency and risk of explosion. Eight to nine feet per second is believed to be ideal, since higher velocities require excessive pumping power. It has also been found that the downward liquid flow velocity in the reactor 34 must be no greater than about one foot per second, preferably about 0.5 foot per second, to assure proper dissolution of the oxygen in the black liquor. As noted with respect to FIGS. 1 and 2, in proper operation the central section of the reactor is a mass of froth, while the upper and lower sections are relatively quiescent. It has been observed that at fiber consistencies up to about 4% in the black liquor of the reactor, fine gas bubbles continue to move upwardly until dissolution is substantially complete. With 1.25% stock the bubbles rise at about 1 to 2 inches per second. At about 4% stock the bubbles become attached to the wood fiber. Furthermore, above 4% the stock-water mass becomes too thick to pump or flow readily. Therefore, in practice the consistency of the fiber should be no greater than about 4%.

The size of the inlet 40 and the diameter of the reactor are determined by the flow volume to be accommodated commensurate with the flow velocities noted above. The gas volume is controlled so that necessary to oxidize the total sulfur present, which is determined by the sulfur content in the black liquor. In the counter-current method of FIG. 5 the oxidation reaction proceeds with a high ratio of oxygen to sulfur at the bottom of the reactor and a high ratio of sulfur to oxygen at the top. It has been found that between 1.0 and 1.2 pounds of oxygen per pound of sulfur to be oxidized, preferably with an operating temperature range of 180° F. to 210° F. and a liquor retention time of at least 40 seconds, is the proper range for substantially complete oxidation and maximum utilization of the oxygen. By virtue of the invention rapid complete dissolution of oxygen and rapid contact of the oxygen somewhat preferentially with the sulfur compounds in the black liquor are attained. This results in fixation of the sulfur with oxygen to the extent that odorous materials will not be released in further processing of the black liquor.

Figure 6:
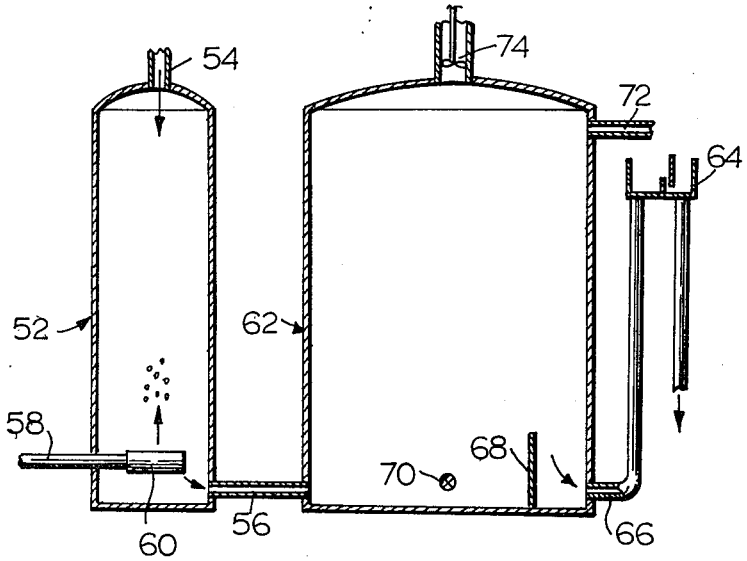

FIG. 6 illustrates another counter-current method of oxidizing sulfur in black liquor in accordance with the invention. In this embodiment the black liquor enters a reactor tower 52 through the inlet 54 at the top, flowing downwardly and leaving the reactor at outlet 56 near the bottom. Fiber contained in the black liquor may act somewhat as a tower packing to aid in oxygen contact with the liquid. Where the fiber is present at less than 2% consistency, reactor 52 may, if desired, be fitted with tubes, rectangular sections, or other conventional devices for aiding the contact of oxygen with the liquid. When fiber is not present, standard packings such as Raschig rings, ceramic shapes, coke, etc. may be used. Oxygen enters the column through inlet 58 and bubbles upwardly through the black liquor in the column via disperser 60 in essentially the same manner as in FIG. 5. Again, the operating parameters (including flow velocities and $O_2/S$ ratios) are critically adjusted as in FIG. 5.

In the embodiment of FIG. 6 a holding tank 62 of modified form is employed. A controlled level of black liquor in the holding tank is maintained through an adjustable weir overflow 64 supplied from an outlet 66 near the bottom of tank 62, a baffle 68 being employed as shown. Air or other inert gas may be injected at 70, as in the embodiment of FIG. 5, and distributed into the liquor in the tank to float and/or froth the soap to the top, where it can be taken off at 72 in a controlled manner through manipulation of the liquor level or by means of a mechanical skimmer. Any excess foam created is broken by a conventional foam breaker, illustrated diagrammatically at 74, to recover additional soap.

FIG. 7 illustrates a commercial size unit employing a vertical tank reactor 76 9 feet 6 inches high and 73.25 inches in diameter. Black liquor containing fiber at 1.4% consistency, for example, enters the tank through inlet 78 at a flow rate of 2000 to 3000 gallons per minute through a 12 inch line at a velocity varying from 8 to 9 feet per second. The velocity downward in the reactor tank varies from 0.158 to 0.226 foot per second, and the dwell time is 41 to 59 seconds. Oxygen of 95% purity (95% oxygen, 5% argon) enters at the bottom through a porous stainless steel disperser 80. Oxidized liquor flows from the bottom of the reactor to a storage tank 82 having a dwell time of 2 minutes. The oxidized black liquor is discharged from the holding tank 82 through outlet 84, and sulfate soap may be collected at the top of tank 82 and discharged through outlet 86. Again, the same critical parameter adjustments are made as in the previously described embodiments. To maximize soap collection, longer dwell times may be provided.

FIG. 8 illustrates a further form of apparatus for the performance of a black liquor oxidation method of the invention. In this embodiment the reactor-dissolver 88, which may be 8 to 10 feet high, for example, and of a diameter to maintain the proper velocity (as in the previous embodiments) for the amount of fluid through-put needed, is supplied with black liquor from an inlet 90. Oxygen-rich gas enters through the disperser 92 as previously described. The oxygenated black liquor discharges to the holding tank 94 provided with a black liquor outlet 96 and a soap outlet 98. If desired, a number of dissolver-reactors 88 may be provided in one tank 94 to avoid unreasonable diameters of the reactor. The reactor-dissolver 88 (as well as other reactor-dissolvers previously mentioned) may be kept full of liquid or vented to the atmosphere at the top. Although, as noted previously, a black liquor inlet velocity of at least 8 feet per second is necessary, the downward velocity of the liquid in the reactor proper should be less than about one foot per second. Velocities of the order of 0.25 foot per second have been found to give good results. The downward velocity must be high enough such that the oxygen does not escape upwardly before dissolution and low enough to keep from sweeping oxygen bubbles out of the reactor-dissolver to the extent that they escape tank 94 or collect at the top of the tank.

FIG. 9 illustrates another form of apparatus for performing a black liquor oxidation method of the invention, in this case a co-current method. In this embodiment the reactor employs a cone 100, to the upper (apex) end of which black liquor is supplied through an inlet 102, again at a velocity of at least eight feet per second. Oxygen-rich gas is added just ahead of the cone via inlet 104. The downward liquid velocity at the outlet (base) end of the cone 106 must be less than about 1 foot per second for proper operation. Thus, in the embodiment of FIG. 9, as well as the other embodiments described above, the velocity of the liquid to be discharged from the reaction chamber is less than about 1 foot per second. Again, as in the previously described embodiments, the oxygen to sulfur ratio should be between 1 and 1.2. The cone reactor 100 discharges at its lower end 106 into a holding tank 108 which contains the cone. Discharge from the tank takes place via the outlet 110 and adjustable weir 112 of the type previously described. Soap may be collected and removed via the outlet 114, air being injected at 116 to facilitate floatation and frothing of the soap. A conventional foam breaker is indicated at 118 to handle any excess foam. Although cone-type gas-liquid reactors have been known previously, the invention employs such reactors with critically ajusted parameters, as noted above, to achieve highly effective, highly efficient, black liquor oxidation never before contemplated.

FIG. 10 illustrates an embodiment in black liquor, which may contain fiber in suspension as in the other embodiments described, is oxidized by means of a conventional venturi 120. The venturi, which like all true venturis comprises successive converging and diverging sections merging at a throat, should be smoothly and carefully machined to provide undisturbed flow except for turbulence at the throat and should be a true venturi rather than simulated types which have been tried in prior proposals. The black liquor is admitted through the inlet pipe 122 and oxygen-rich gas is injected via inlet 124 just before the throat of the venturi. It has been discovered that for satisfactory oxidation of the black liquor the throat velocity must be at least 22 feet per second. 22–23 feet per second is considered ideal, since too high a velocity requires too much pumping power and too high oxygen-rich gas pressure. The flow volume dictates venturi and pipe size. Again, the amount of total sulfur to be oxidized determines the amount of oxygen to be injected, but the oxygen to sulfur ratio should be between 1 and 1.2. Leaving the venturi, the black liquor enters a holding tank 62, which in the form shown is substantially identical to that illustrated in FIG. 6, in which the reaction is completed and soap is collected. The venturi 120 may be employed singly or in tandem with another such venturi, for example. Instead of employing the holding tank 62, the venturi(s) may discharge into a length of pipe sufficient to insure completion of the reaction.

In experiments employing venturis in accordance with the invention, two carefully machined true venturis were employed in series using oxygen at 25 p.s.i.g. The venturis were installed in a section of 1.2 inch diameter pipe. Oxygen was added just ahead of the throat of the first venturi. The second venturi was 5 feet downstream of the first, and the entire reactor was 15 feet long. Oxygen quantities were varied and black liquor flows were varied. The following table illustrates the results.

TABLE V

| Flow GPM | S Lbs./1000 gal. Black Liquor | S LBs./1000 gal. Oxidized Liquor | Ratio $O_2$/S |
|---|---|---|---|
| 18.4 | 5.069 | 0.645 | 1.45 |
| 18.4 | 5.069 | 1.21 | 1.32 |
| 18.4 | 5.069 | 1.49 | 1.18 |
| 18.4 | 5.069 | 1.77 | 1.07 |
| 19.2 | 9.33 | 0.48 | 1.66 |
| 19.2 | 9.33 | 1.79 | 1.34 |
| 19.2 | 9.33 | 3.55 | 0.99 |
| 19.2 | 9.33 | 5.44 | 0.70 |
| 19.2 | 9.33 | 7.20 | 0.33 |
| 28.8 | 12.61 | 5.45 | 0.51 |
| 28.8 | 12.61 | 4.32 | 0.69 |
| 28.8 | 12.61 | 2.66 | 0.86 |
| 28.8 | 12.61 | 1.22 | 1.02 |
| 31.2 | 10.54 | 8.11 | 0.19 |
| 31.2 | 10.54 | 5.10 | 0.56 |
| 31.2 | 10.54 | 1.78 | 0.94 |
| 31.2 | 10.54 | 0.45 | 1.12 |
| 31.2 | 10.54 | N.D.* | 1.31 |

*N.D. - None detectable.

The flow of 31 g.p.m. exceeds 22 feet per second. These data indicate that a velocity of 22 feet per second is the minimum liquid flow velocity required to attain the completeness of reaction required.

When two venturis are used, oxygen-rich gas may be supplied to both, but the second venturi will usually receive less gas than the first and serve as a "touch-up."

While preferred forms of the invention have been shown and described, it will be apparent that modifications can be made without departing from the principles and spirit of the invention, the scope of which is defined in the following claims. For example, various portions of the apparatus of FIGS. 5–10 may be interchanged (as by using the discharge arrangement 64–68 of FIG. 6 instead of 46 in FIG. 5 and vice versa). Also, oxygenation concepts of this invention may be applied to treat other substances, such as the effluent from activated sludge plants.

The invention claimed is:

1. A method of oxidizing substantially all of the sulfur in weak black liquor from a kraft pulp process which comprises oxidizing sulfur in the weak liquor at a point in the process between the blow tank and the pulp washer by the injection into the liquor of sufficient oxygen-rich gas to oxidize substantially all of the sulfur present in the weak black liquor and until the sulfide concentration in the weak black liquor is substantially zero.

2. A method in accordance with claim 1, wherein the amount of oxygen injected is between about 1 pound and about 1.2 pounds of oxygen per pound of sulfur to be oxidized.

3. A method in accordance with claim 1, wherein the black liquor contains amounts of fiber of up to about 4% concentration by weight.

4. A method in accordance with claim 1, wherein the oxygen-rich gas is injected into the liquor in countercurrent flow.

5. A method in accordance with claim 4, wherein the liquor flows downwardly in a reactor substantially filled with weak black liquor and the oxygen-rich gas flows upwardly through the liquor in the reactor as finely divided bubbles.

6. A method in accordance with claim 5, wherein the free oxygen concentration at the top of the reactor is substantially zero.

7. A method in accordance with claim 1, further comprising measuring the sulfide concentration after said oxidizing and varying the amount of oxygen injected to oxidize substantially all of the sulfur present with minimal oxygen.

8. A method in accordance with claim 1, further comprising transferring the oxidized black liquor to a storage tank, floating sulfate soap to the upper portion of the tank, and collecting said soap.

9. A method in accordance with claim 8, wherein sufficient air is introduced into the tank to facilitate floatation of the soap without excessive foaming.

10. A method in accordance with claim 1, wherein the oxygen-rich gas is injected into black liquor flowing into the apex region of a conical reactor.

11. A method in accordance with claim 1, wherein the oxygen-rich gas is injected into black liquor flowing into the throat of a venturi.

12. A method in accordance with claim 1, wherein said oxidizing comprises providing a reaction chamber at said point, pumping the black liquor through an inlet of said reaction chamber and downwardly through said reaction chamber while injecting said oxygen-rich gas into said liquor and causing small gas bubbles to be dispersed in the liquor flowing through said reaction chamber, and discharging oxygenated black liquor from said reaction chamber near the lower end thereof, the flow velocity of the black liquor through said inlet being at least about 8 feet per second, and the flow velocity of the oxygenated black liquor to be discharged from said reaction chamber being less than about one foot per second.

13. A method in accordance with claim 12, wherein the black liquor and the oxygen-rich gas are in countercurrent flow.

14. A method in accordance with claim 12, wherein the amount of oxygen injected is between about 1 pound and 1.2 pounds per pound of sulfur in the black liquor.

15. A method in accordance with claim 12, wherein the reaction chamber comprises a vertical column, the black liquor being introduced to the column near the top thereof and the oxygen-rich gas being introduced to the column near the bottom thereof.

16. A method in accordance with claim 12, wherein the reaction chamber comprises a cone, the black liquor being introduced into the reaction chamber near the apex region of the cone and discharging from the reaction chamber near the base of the cone into a holding tank containing the cone.

17. A method in accordance with claim 2, wherein the reaction chamber comprises a vertical column, the black liquor flowing downwardly therethrough at a velocity in the range of about 0.10 to about 0.25 f.p.s. and the gas bubbles flowing upwardly therein at about one to two inches per second.

18. A method in accordance with claim 1, wherein said oxidizing comprises providing at said point, at least one venturi having smooth successive converging and diverging sections joined at a throat, pumping the liquor through said venturi at a throat velocity of at least about 22 feet per second, injecting said oxygen-rich gas into the black liquor in the region of said throat, and passing the oxygenated black liquor from the venturi through a reaction region.

19. A method in accordance with claim 18, further comprising introducing the output of said one venturi to the inlet of a second venturi in tandem.

20. A method in accordance with claim 1, wherein the amount of oxygen injected is between about 1 pound and about 1.2 pounds of oxygen per pound of sulfur in the weak black liquor.

21. In a kraft pulp process, the steps of oxidizing substantially all the sulfur in fiber-containing weak black liquor with oxygen-rich gas between the blow tank and the washer without removal of the fiber from the liquor and until the sulfide concentration in the weak black liquor is substantially zero, and thereafter separating soap from the black liquor.

22. A process in accordance with claim 21, wherein the oxidizing is carried out in a reaction chamber, and the separating is carried out in a holding tank to which black liquor is transferred from the reaction chamber.

23. A process in accordance with claim 22, wherein the production of soap is enhanced by air floatation in said tank.

24. A process in accordance with claim 22, wherein the production of soap is enhanced by controlled foaming in said tank and foam breaking.

25. A method in accordance with claim 7, wherein the sulfide concentration is measured by a specific ion electrode connected to a millivolt meter and wherein the output of the meter controls a valve varying the oxygen feed.

26. A method of oxidizing sulfur in black liquor from a kraft pulp process, which comprises pumping the black liquor through an inlet of a vertical reaction chamber and downwardly through the reaction chamber while injecting an oxygen-rich gas into said black liquor and causing small gas bubbles to be dispersed in the liquor and to flow upwardly through said reaction chamber, and discharging oxygenated black liquor from said reaction chamber near the lower end thereof, the flow velocity of the black liquor through said inlet being at least about 8 feet per second, and the flow velocity of the oxygenated black liquor to be discharged from said reaction chamber being less than about 1 foot per second, the amount of oxygen-rich gas injected being sufficient to oxidize substantially all of the sulfur present in the black liquor and the oxidizing being carried out until the sulfide concentration is substantially zero.

27. A method in accordance wwith claim 26, wherein the amount of oxygen-rich gas injected is substantially the minimum required to perform the oxidation, and wherein the oxygenated black liquor is stored in a holding tank and sulfate soap is separated from the black liquor in said tank by introducing just enough gas into the oxygenated black liquor in said tank to facilitate the floatation of soap without producing excessive foam.

28. A method in accordance with claim 26, wherein the black liquor flow velocity in said reaction chamber is in the range of about 0.10 to about 0.25 f.p.s., and wherein the gas bubbles flow upwardly in said reaction chamber at a velocity of about 1 to 2 inches per second.

29. A method in accordance with claim 26, wherein the black liquor contains fiber of consistency no greater than about 4% by weight.

* * * * *